United States Patent [19]

Yang

[11] 4,132,635

[45] Jan. 2, 1979

[54] BENEFICIATION OF IRON ORES BY FROTH FLOTATION

[75] Inventor: David C. Yang, Houghton, Mich.

[73] Assignee: Michigan Technological University, Houghton, Mich.

[21] Appl. No.: 759,094

[22] Filed: Jan. 13, 1977

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,951,326 | 3/1934 | De Vorey | 209/166 |
| 2,709,541 | 11/1956 | Perry | 209/166 |
| 2,861,687 | 11/1958 | Lord | 209/167 |
| 3,337,048 | 8/1967 | Mercade | 209/166 X |
| 3,589,622 | 6/1971 | Weston | 209/166 X |

*Primary Examiner*—Robert Halper

*Attorney, Agent, or Firm*—Michael, Best & Friedrich

[57] ABSTRACT

Iron oxides of finely-ground, low grade, siliceous oxidized iron ores can be effectively floated from the silica-bearing gangue in the presence of slime by conditioning an aqueous pulp of the ore with a reagent formed by incorporating a water-soluble polyvalent metal salt into an aqueous solution of an alkali metal silicate prior to subjecting the pulp to froth flotation in the presence of an anionic type collector.

12 Claims, 1 Drawing Figure

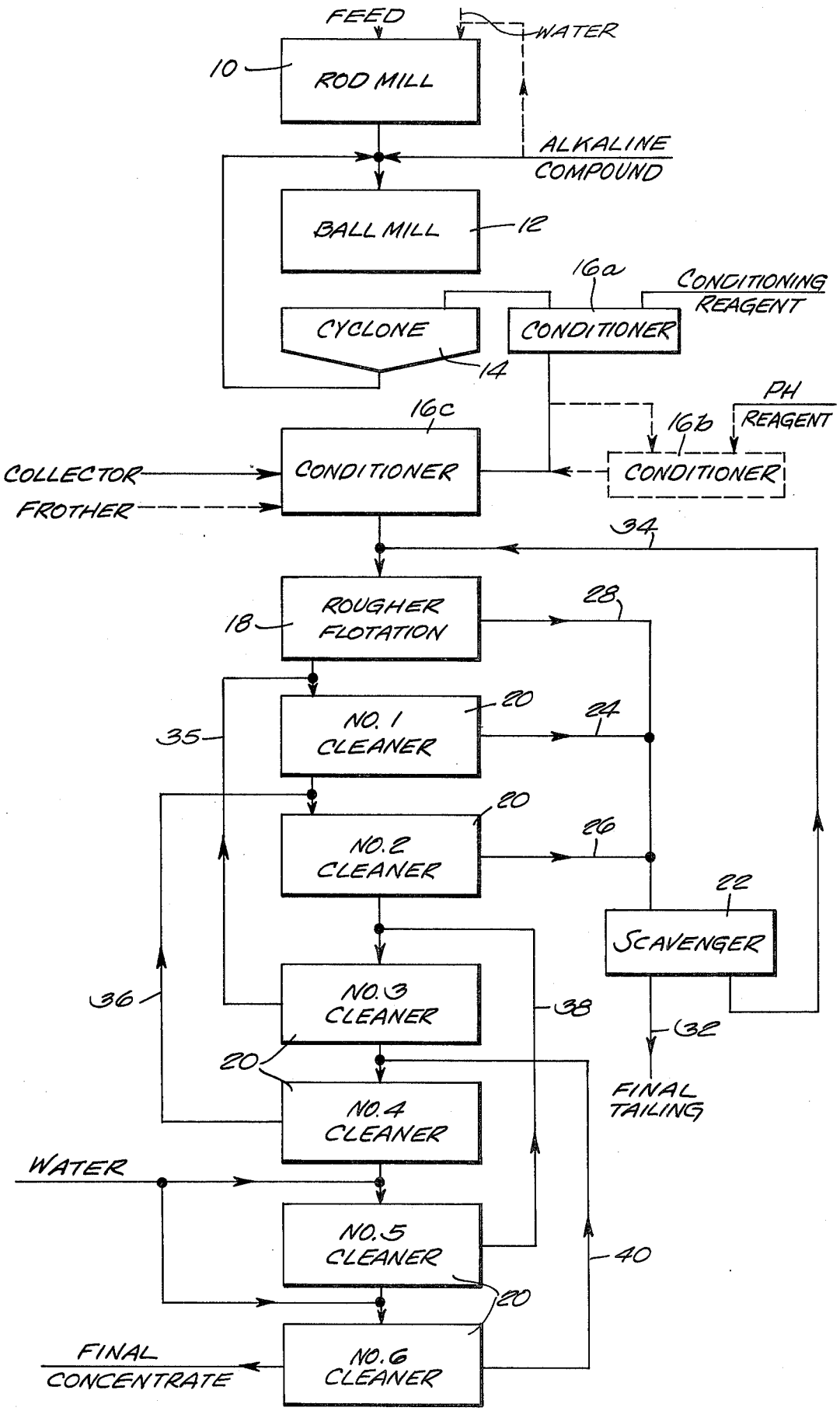
FEED
WATER
10
ROD MILL
ALKALINE COMPOUND
BALL MILL
12
16a
CONDITIONING REAGENT
CYCLONE
CONDITIONER
14
PH REAGENT
16c
16b
COLLECTOR
CONDITIONER
CONDITIONER
FROTHER
34
ROUGHER FLOTATION
28
18
NO. 1 CLEANER
20
24
35
NO. 2 CLEANER
20
26
22
SCAVENGER
36
NO. 3 CLEANER
38
32
20
NO. 4 CLEANER
FINAL TAILING
WATER
NO. 5 CLEANER
40
20
FINAL CONCENTRATE
NO. 6 CLEANER

BENEFICIATION OF IRON ORES BY FROTH FLOTATION

BACKGROUND OF THE INVENTION

This invention relates to the beneficiation of iron ore and, more particularly, to a process of beneficiating low-grade, siliceous oxidized iron ores by froth flotation.

Many low-grade iron ores are too low in iron and too high in silica-bearing gangue to be suitable for use in iron and steel making processes. Consequently, such ores must be treated to separate the iron oxide content from the gangue. Froth flotation processes have been employed for this purpose. In such processes the iron oxide is floated from the silica by use of anionic collectors, or a reverse flotation scheme is employed whereby silica is floated from the iron oxide by use of cationic collectors or anionic collectors activated by a calcium ion.

Many iron ores must be ground to a very fine size to permit liberation of iron oxides from the gangue, resulting in the reduction of some of the silica and other materials to slimes which interfere with the flotation process. This problem can be minimized by desliming the iron ore pulp before flotation. However, such a desliming step adds to processing costs and loss of the iron values. For example, losses up to as much as 25 to 30% of the iron are quite common in flotation processes including a desliming step.

While eliminating grinding of the ore to a degree at which slimes are artificially produced would alleviate problems associated with the presence of slime, such an approach cannot be used for many ores in which the iron oxide is tightly interlocked with silica and/or other gangue materials and fine grinding is required to obtain an acceptable liberation of the iron oxide. Processes have been proposed wherein flotation is effected in the presence of slime; however, none have been commercially adopted to any appreciable extent because the concentrate is of poor quality, the process is effective for a limited number of ores, precise control of the operating conditions is required and/or the number of process steps involved, the type and quantity of reagents used, etc., result in excessive operating costs.

Examples of prior art flotation processes employing anionic type collectors for floating iron oxide from a silica-bearing gangue are disclosed in U.S. Pat. Nos. 2,769,541 (Perry), 2,861,687 (Lord) and 3,589,622 (Weston). Examples of prior art flotation processes in which the silica-bearing gangue is floated from iron oxide are disclosed in U.S. Pat. Nos. 2,423,022 (Herkenhoff) and 3,292,780 (Frommer et al).

SUMMARY OF THE INVENTION

The principal object of the invention is to provide a simple, efficient and economical process for beneficiating low-grade iron ores.

Another principal object of the invention is to provide a froth flotation process which is capable of separating iron oxide from siliceous iron ores without desliming and yet obtain a high recovery of the iron values.

Other aspects, advantages and objects of the invention will become apparent to those skilled in the art upon reviewing the following detailed description, the drawing and the appended claims.

According to the invention, the iron oxide values of a siliceous iron ore are floated from silica and other gangue slimes by a froth flotation process wherein an aqueous pulp of the ore is treated with a conditioning reagent which improves the selectivity of anionic collectors to iron oxide particles. More specifically, the conditioning reagent is formed by incorporating a water-soluble polyvalent metal salt into an aqueous solution of a water-soluble alkali metal silicate. The conditioning reagent is added to and thoroughly mixed with the pulp before the pulp is subjected to conventional froth flotation in the presence of an anionic collector as the flotation agent.

U.S. Pat. No. 3,337,048 (Mercade) discloses a flotation process employing an anionic collector and a dispersant reagent containing sodium silicate and a polyvalent metal salt for floating colored titaniferous impurities from kaolin clay. However, it is well recognized that the flotation art is highly empirical and that wide variety of factors may have a substantial or even a critical effect on the degree of separation attained. Therefore, determination of a combination of treatment reagents and/or operating conditions to obtain an effective separation of a particular material is largely unpredictable and can be obtained only by extensive testing and experimentation. The use of a conditioning reagent containing a water-soluble alkali metal silicate and a water-soluble polyvalent salt in combination with an anionic collector, in accordance with the invention, has been found to be surprisingly effective in the flotation of iron oxide from silica in the presence of slimes.

While not completely understood at this time, and the invention is not limited to any specific theory, it appears that the conditioning reagent of the invention either modifies the surface characteristics of the slime particles or it is adsorbed on the surface of the slime particles so as to prevent anionic collectors from bonding thereto and yet permits the slime particles to become wetted so they will not float during froth floation. It appears that the conditioning reagent also modifies the surface characteristics of the iron oxide particles so they can more readily adsorb anoinic collectors and thereby become more readily attached to air bubbles during froth floation.

The process of the invention, while eliminating the cost of a desliming step, has been found to be capable of recovering up to 15% or more iron from low-grade iron ores than present commercial flotation processes.

BRIEF DESCRIPTION OF THE DRAWING

The single drawing is a schematic flow diagram illustrating a continuous froth flotation process embodying the invention.

DESCRIPTION OF THE PREFERRED EMBODIMENTS

As is the usual case for low-grade siliceous oxidized iron ores, the ore to be treated is first ground to a fine size feed to permit liberation of iron oxide from the silica-bearing gangue. Various conventional grinding techniques can be employed. In the specific continuous process illustrated in the flow diagram crushed ore at a nominal size of about ½ inch is introduced into a rod mill 10 along with a sufficient amount of water to produce a slurry containing, for example, about 60% solids.

The pulp discharged from the rod mill 10 is subjected to closed-circuit grinding, first being transferred to a ball mill 12 for further grinding and then to a conventional particle size classification device, such as a cyclone classifier 14. The ore is ground in the ball mill 12 to a predetermined fineness desired for the subsequent froth flotation. As is well known in the art, the particular particle size to which the ore is ground depends primarily on the specific ore being processed with finer particle size being required for ores having the gangue more tightly interlocked with the iron oxide. Ore particles larger than the predetermined maximum size, e.g., the underflow from the cyclone classifier 14, are recirculated to the ball mill for further grinding. The ground pulp containing particles are less than the predetermined maximum size, e.g., the overflow from the cyclone classifier 14, is transferred to a plurality of conditioners 16*a*, 16*b* and 16*c* wherein the conditioning reagent, a pH adjustment reagent and an anionic collector, respectively, is added to and mixed with the pulp prior to froth flotation.

To obtain the best results with most ores, the pH of the ore pulp should be within the range of about 7 to about 11, preferably within the range of about 8 to about 9, prior to conditioning. In some cases, the pH of the ore pulp may fall within the desired range without the addition of any reagents, depending on the amount and type of specific ore being treated, the state of division of the ore, the amount and hardness of the water used, etc. By using a pH within these ranges, there is less tendency for certain of the gangue minerals to flocculate and become entrained in the concentrate during froth flotation or, conversely, for the mineral values to be lost in the tailings.

Most frequently, an upward adjustment of the pH of the pulp is required to fall within the desired range, in which case a water-soluble alkaline inorganic compound is thoroughly mixed with the pulp. Various water-soluble alkaline inorganic compounds conventionally used for pH regulation are acceptable, particularly the carbonates and hydroxides. Soda ash presently is the preferred alkaline inorganic compound; however, other compounds, such as sodium hydroxide, sodium silicate, sodium fluosilicate, sodium fluoborate, sodium phosphate, sodium borate, ammonium carbonate and the like, may be substituted in whole or in part for the soda ash. The amount of the alkaline inorganic compound used depends on, among other things, the variables mentioned above and the optimum quantity is best determined empirically. Generally, the amount used for most ores will be within the range of about 0.1 to about 5 pounds per ton of ore. As used herein, the term "ton" means short ton or 2,000 pounds avoirdupois.

The alkaline inorganic compound preferably is added to the pulp at a point in the system prior to the addition to the conditioning reagent. In the specific continuous process illustrated in the flow diagram, the alkaline inorganic compound is added to the pulp, either prior to or along with, its introduction into the ball mill 12 for the final grinding as shown by the solid line in the flow diagram. Optionally, the alkaline inorganic compound can be introduced into the rod mill 10 along with the water as shown by the dotted line in the flow diagram. When added at either of these points in the system, the alkaline inorganic compound is simultaneously mixed with the pulp during grinding.

In cases where the pH of the pulp has to be adjusted downwardly to fall within the desired range, an acid reagent, such as sulfuric acid, which does not introduce undesirable ions into the pulp can be used for this purpose.

The solids content of the pulp during conditioning is not particularly critical. It can be 50% or even higher depending on the particular ore or advatageously can be as low as 5%. When the pulp is to be diluted, the additional water can be added to the pulp either before or after its introduction into the conditioner.

The conditioning reagent is added to the pulp as an aqueous solution and is formed by incorporating a water-soluble polyvalent metal salt into an aqueous solution of a water-soluble alkali metal silicate. As used herein, the term "water-soluble polyvalent metal salt" encompasses metal salts containing a polyvalent metallic cation of Group Ib or higher in the Periodic Table, *Handbook of Chemistry and Physics*, 56th Ed., CRC Press, Inc., (1975) and various water-soluble hydrated salts containing such cations.

Representative examples of suitable polyvalent metallic cations for the polyvalent metal salt include iron (ferrous and ferric), copper (cupric), aluminum, lead, chromium, manganese, cobalt, nickel, zinc, cadmium, magnesium, calcium, barium and mixtures thereof. Polyvalent metal salts containing iron (ferrous and ferric) as the cation are preferred, with those having ferric ion as the cation being the most preferred, because of their availability and they contain ions common to the lattice constituents of minerals to be separated, e.g., iron oxide. It is presently believed that the iron oxide is activated by this common ion effect.

The water-soluble polyvalent metal salt can contain various anions including nitrates, sulfates, chlorides and acetates.

Representative examples of water-soluble polyvalent metal salts which are particularly suitable for use in the conditioning reagent include ferric nitrate, ferric chloride, ferrous nitrate, ferrous sulfate, cupric sulfate, cupric nitrate, aluminum sulfate, aluminum nitrate, aluminum chloride, lead nitrate, lead acetate, manganous sulfate, manganous chloride, zinc sulfate, zinc chloride and mixtures thereof.

The amount of polyvalent metal salts used is within the range of about 0.02 to about 2, preferably within the range of about 0.05 to about 1, pounds per ton of ore.

Suitable water-soluble alkali metal silicates include sodium silicate, potassium silicate, and mixtures thereof with sodium silicate being preferred. Particularly suitable are sodium silicates containing a weight ratio of $Na_2O$ to $SiO_2$ within the range of about 1:1 to about 1:3.75, preferably about 1:3.22.

The amount of alkali metal silicate used is within the range of about 0.05 to about 4, preferably within the range of about 0.1 to about 1, pounds per ton of ore in terms of the calculated $SiO_2$ equivalent. A commercially available solution of sodium silicate, containing about 9.15 weight % $Na_2O$, 29.5 weight % $SiO_2$ and about 62 weight % water and marketed by Philadelphia Quartz Co. as "O" Brand sodium silicate solution, is particularly suitable for use in preparing the conditioning reagent. The amount of this solution used is within the range of about 0.1 to about 14, preferably within the range of about 0.3 to about 4 pounds per ton of ore.

The conditioning reagent is prepared by forming a dilute aqueous solution of the water-soluble polyvalent metal salt and slowly adding this salt solution to an aqueous solution of the alkali metal silicate. In a preferred method for preparing the conditioning reagent, sufficient water is added to the above-mentioned commercially available "O" Brand sodium silicate solution to form a 5 weight % aqueous solution thereof, forming a dilute aqueous solution of the water-soluble polyvalent metal salt, e.g., a 2 weight % aqueous solution of ferric nitrate, $Fe(NO_3)_3 \cdot 9\ H_2O$, and slowly adding the salt solution to the diluted sodium silicate solution with stirring.

The polyvalent metal salt reacts with the sodium silicate and forms reaction products which are colloidally dispersed in the aqueous medium. Generally, the salt solution is added until the system becomes turbid without significant precipitation of the reaction products. Unless continuously agitated, the resultant colloidal dispersion becomes unstable within a relatively short time, e.g., within about 5 minutes. If the colloidal dispersion is added to the pulp within this time period and the pulp is at a pH at the lower end of the above-mentioned range, it can be used as a conditioning reagent without further treatment. However, such an operation ordinarily is not practical for commercial processes because it usually is more convenient to make up relatively large batches of the conditioning reagent for use as needed. Therefore, it is preferred to add a sufficient amount of an acid reagent, such as sulfuric acid, to the colloidal dispersion so as to solubilize the reaction products and form a system which is stable for extended time periods, preferably for periods up to several months. When the conditioning reagent is so stabilized, the desired amount of the active ingredients thereof can be accurately fed into the system as required.

When used, the amount of acid reagent added to the colloidal dispersion depends primarily upon the amount and particular type of polyvalent metal salt used. Generally, the acid reagent is slowly added to the colloidal dispersion until it changes from a turbid condition to a clear solution and the pH of the resultant solution is within the range of about 2 to about 5 depending upon the type of metal salt used. On the basis of the pulp, the amount of acid reagent used is 0 to about 2, preferably about 0.05 to about 1, pounds per ton of ore. The preferred weight ratio of the alkali metal silicate, in terms of the calculated $SiO_2$ equivalent, to the polyvalent metal salt and to the acid reagent is 2:1:1.

After the conditioning reagent has been added to the pulp, it is agitated in the conditioner 16a for a sufficient time to insure uniform dispersion thereof throughout the pulp. Generally, an agitation time of about 1 to about 5 minutes will be sufficient for this purpose.

Following initial conditioning in the conditioner 16a, the pH of the pulp preferably is finally adjusted to a value within the range of about 6 to about 10, most preferably within the range of about 8 to about 9. In some cases, the addition of the conditioning reagent may alone be sufficient to adjust the pH to the desired value, depending primarily on the amount and type of ore being processed, the amount and hardness of the water being used and whether or not the conditioning reagent contains an acid reagent. In other cases, it may be necessary to make a final adjustment of the pH, either upwardly or downwardly, in order to obtain an optimum value when required, such a final pH adjustment most preferably is made just prior to the addition of the collector in which case the pulp is transferred to the conditioner 16b. Since this adjustment may not be required for some ores, the conditioner 16b is shown in dashed lines in the flow diagram.

When a downward adjustment of the pH is required, any acid reagent which does not introduce undesirable ions into the pulp is added to and thoroughly mixed with the pulp in the conditioner 16b. Generally, sulfuric acid is preferred because of its low cost and availability. In those cases where an alkaline agent is required to adjust the pH upwardly, similar conditions apply. Generally, any of the above-described water-soluble, alkaline inorganic compounds can be used for this purpose.

Following initial conditioning of the pulp in the conditioner 16a, and preferably after final pH adjustment in the conditioner 16b (when required), the pulp is transferred to conditioner 16c wherein an anionic type of collector is added to and thoroughly mixed therewith. While less desirable, the agent required for making the final adjustment of the pH of the pulp can be added to the pulp after the collector so long as the pulp is subsequently agitated.

Various conventional anionic collectors known to be selective for flotation of iron oxide can be used. Suitable anionic collectors are the higher and intermediate, saturated and unsaturated fatty acids and water-soluble soaps thereof containing at least about 8 and up to about 20, preferably between 10 and 18, carbon atoms in their primary chains.

Representative examples of suitable anionic collectors include oleic acid, linoleic acid, linolenic acid, stearic acid, palmitic acid, rosin acid, fish oil fatty acid, water-soluble soaps derived from these acids, and mixtures of such acids and/or soaps. Fatty acids of low rosin content generally are the preferred collectors because of their lower cost and availability. Examples of particularly suitable commercially available anionic collectors include PAMAK-4, which is a refined fatty acid collector comprised primarily of oleic and linoleic acids and marketed by Hercules, and FA-2 and L-4 which are similar products marketed by Arizona Chemical and West Virginia Chemical, respectively.

Generally, the amount of collector used is within the range of about 0.1 to about 3, preferably within the range of about 0.5 to about 2 pounds per ton of ore.

After the collector has been added, the pulp is agitated in the conditioner 16c for a sufficient time to insure uniform dispersion of the collector throughout the pulp. Generally, an agitation time of about 5 to about 20 minutes will be sufficient for this purpose.

As alluded to above, one of the advantages of the invention is that the solids content of the pulp during conditioning can be substantially lower than for conventional flotation processes employing fatty acid collectors. Such conventional processes typically require a solids content of 50% or more during conditioning and, consequently, intense agitation of the pulp usually is required. Also, the pulp usually must be concentrated after classification, either in a separate thickening step or concurrently with a desliming step. In either case, iron values are lost in the overflow or tailings.

In accordance with one aspect of the invention, conditioning can be carried out at a solids content within the range of about 5 to about 30%, thereby eliminating the necessity for concentrating the pulp after classification and decreasing the energy required for agitation. On the other hand, the solids contents can be at a higher level, e.g., 50% or higher, typically used in conventional processes.

Following final conditioning in the conditioner 16c, the conditioned pulp is processed in a conventional flotation circuit which typically includes a rougher flotation stage 18 wherein the iron oxide floats and is separated as a concentrate in the froth and silica and other gangue materials report in the tailings. The froth and tailing from the rougher flotation stage 18 may then be subjected to a plurality of conventional cleaning and/or scavenging steps to improve the grade of the iron concentrate and to maximize recovery of iron oxides.

Fatty acid, anionic collectors normally provide adequate frothing during re-float cleaning steps. In some cases it may be necessary to add a small amount of fuel oil or a conventional frothing agent, such as the higher alcohols (e.g., methyl isobutyl carbinol), pine oil, cresylic acid, and the like. The amount of frothing agent used depends primarily upon the number of cleaning steps involved, with larger amounts being used as the number of cleaning steps is increased. When used, the frothing agent can be incorporated into the pulp before, after, or together with the collector and, generally, in amounts up to about 0.5 pounds per ton of ore. If the frothing agent is added separately, the pulp is agitated for a sufficient time to insure uniform dispersion of the forthing agent throughout the pulp. Generally, an agitation time of up to 2 minutes will be sufficient for this purpose.

While the solids content of the pulp for flotation can vary over a wide range, it preferably is within the range of about 5 to about 35%. Depending on the solids content of the pulp during conditioning, it may be necessary to dilute the pulp with water to obtain the desired value for flotation.

While various conventional cleaning circuits can be used after rougher flotation, in the specific process illustrated in the flow diagram, six re-flotation cleaners 20 and a scavenger 22 are used. The tailings 24 and 26 from the first and second cleaners are combined with the rougher tailing 28 and the combined tailings are passed to the scavenger 22 to produce a final tailing 32 which is transferred to a waste pond and a froth 34 which is recycled to the rougher 18. The tailings, 35, 36, 38 and 40 from the third, fourth, fifth and sixth cleaners are recycled to the first, second, third and fourth cleaners, respectively.

The process is generally effective for beneficiating siliceous oxidized iron ore; particularly those for which conventional magnetic separation is not effective. For example, the process can be used for beneficiating iron ores of the type containing hematite, martite, limonite, goethite and mixtures thereof, usually referred to as oxidized ores. The process also can be used for beneficiating magnetic ores, such as magnetite; however, flotation processes usually are not used for magnetic ores because magnetic separations processes usually are less expensive. The process generally can be operated at atmospheric pressures and temperatures, thereby minimizing the necessity for special operating conditions or special equipment.

Among the several particular advantages of the process of the invention, probably the most important is the fact a high recovery of iron values can be obtained from low-grade ores even though relatively small amounts of inexpensive reagents can be employed. Accordingly, the process offers the potential for developing and utilizing huge low-grade iron ore resources which heretofore have not been tapped because of the lack of an economical method for beneficiation.

While the invention has been described in connection with a system which does not include a desliming step, it should be understood that the conditioning reagent can be used in a system which employs desliming to improve the recovery of iron values.

The following specific examples are presented to illustrate the invention and are not to be construed as limitations thereof.

EXAMPLE 1

A conditioning reagent in accordance with the invention was prepared by slowly adding, with stirring, 1.5 ml of a 2% solution of ferric nitrate, $Fe(NO_3)_3 \cdot 9\ H_2O$, to 3 ml of a 5% solution of "O" Brand sodium silicate solution described above and then stirring the resultant reaction medium for 1 minute to form a turbid colloidal dispersion. 0.25 ml of 15% sulfuric acid was then slowly added with stirring to the dispersion at 25° C to form a clear solution. The pH of the resultant solution was 2.4 and the weight ratios of the "O" Brand sodium silicate solution (as purchased) to the ferric nitrate and to sulfuric acid were 5:1:1.

600 g of −10 mesh low grade iron ore containing primarily hematite, martite and goethite, were wet ground for 50 minutes in a stainless steel rod mill with an amount of soda ash equivalent to 2.5 lb./ton of ore and with a sufficient amount of deionized water to produce a slurry containing about 60% solids.

The ground charge, about 85% of which passed a 500 mesh screen, was transferred to a container and diluted with sufficient additional water to give a pulp containing about 25 weight % solids. 4.75 ml of the previously prepared conditioning reagent (equivalent to 0.15 lb. silica/ton of ore, 0.1 lb. ferric nitrate/ton of ore, and 0.1 lb. sulfuric acid/ton of ore) was added to the pulp and the pulp was subsequently conditioned for 2 minutes in a laboratory Fagergren machine operated at 1250 RPM, during which time the pH of the pulp was adjusted to about 8.8 by adding sulfuric acid. An amount of PAMAK-4 equivalent to 1.5 lb./ton of ore was then added and the pulp, at a solids content of about 23%, was conditioned for 1 more minute. An amount of No. 2 fuel oil equivalent to 0.1 lb./ton of ore was then added and the pulp was conditioned for another 7 minutes.

The conditioned pulp was transferred to a laboratory Fagergren flotation machine, followed by rougher flotation for 6 minutes at 1250 RPM. The rougher concentrate (froth product) was cleaned by successively refloating 6 times in flotation cells using fresh water for dilution and without additonal conditioning or frothing agents. The final concentrate and tailings were weighed and analyzed for iron. The metallurgical results from this test are summarized in Table I.

Table I

| Product | Weight % | % Fe | % Fe Distribution |
|---|---|---|---|
| Head | 100.0 | 34.8 | 100.0 |
| Concentrate | 46.9 | 65.4 | 88.2 |
| Tailings | 53.1 | 7.7 | 11.8 |

Tests were run in a pilot plant having a continuous circuit similar to that illustrated in the flow diagram and designed to process 650 pounds of ore per hour. The same chemical reagents at approximately the same concentration described above were added to the pulp stream prior to being pumped into conditioners herein agitation was provided by propeller-type impellers. Several runs were made with the same ore described above and more than about 80% of the iron was recovered as high grade concentrates in all but a few isolated cases.

EXAMPLE 2

A variety of non-magnetic iron ores were processed in substantially the same manner described in Example 1, using the same chemical reagents at approximately the same concentration. The same ores were processed with the only commercial flotation process presently being used to any extent which process employs a selective flocculation desliming treatment and a cationic-amine collector to float silica from iron oxide. These ores differed somewhat in chemical and mineralogical characteristics but all included quartz interlocked with the major minerals. The results from these tests are summarized in Table II below wherein the different ores are identified by the major iron minerals and, under the "Process Used" heading, "A" designates the process of the invention and "B" designates the commercial process. From these results, it can be seen that for the same ores the process of the invention is capable of attaining iron recovery significantly higher than that attainable with the commercial process, i.e., about 6 to about 17% more iron recovery depending upon the particular ore. Similar comparative results have been obtained on specular hematite ores which require a relatively coarse grind for liberation.

From the foregoing description, one skilled in the art can easily ascertain the essential characteristics of this invention, and without departing from the spirit and scope thereof, can make various modifications and changes to adapt the invention to various usages and conditions.

TABLE II

Comparison Of Iron Recovery From Low Grade Ores - Process Of Invention vs. Commercial Process

| Ore Type | Process Used | Particle Size Pulp, % Pass 500 Mesh | Head Assay Wt. % Fe | Concentrate Wt. % | Concentrate Assay Wt. % Fe | Concentrate Assay Wt. % $SiO_2$ | Fe Recovery, Wt. % |
|---|---|---|---|---|---|---|---|
| Hematite-Martite | A | 91.2 | 34.5 | 47.7 | 66.0 | 4.95 | 91.3 |
| | B | 97.2 | 35.3 | 42.8 | 66.3 | 4.70 | 80.4 |
| Martite-Goethite | A | 85.9 | 35.3 | 44.6 | 64.0 | — | 80.8 |
| | B | 84.4 | 36.3 | 42.7 | 63.9 | 4.80 | 75.2 |
| Martite-Hematite | A | 95.4 | 40.1 | 42.0 | 65.6 | 6.98 | 68.7 |
| | B | 94.5 | 39.5 | 37.3 | 65.4 | 6.19 | 61.9 |
| Martite-Goethite | A | 93.1 | 37.9 | 45.6 | 63.3 | 10.9 | 76.1 |
| | B | 90.3 | 38.8 | 36.3 | 65.2 | 5.83 | 61.0 |
| Mine Run[a] | A | 89.6 | 36.3 | 47.6[b] | 65.8[b] | — | 86.9[b] |
| | B | 82.8[c] | 36.4 | 38.7[c] | 66.0[c] | 4.83[c] | 70.2[c] |

Notes:
[a]Hematite and martite major iron minerals finely interlocked with quartz grains
[b]Average of 3 tests
[c]Average of 6 tests

I claim:

1. A method of beneficiating siliceous oxidized iron ores by froth flotation of iron oxide from silica-containing gangue including the steps of forming an aqueous pulp of the ore having a particle size suitable for froth flotation;

conditioning the pulp by adding thereto a pre-mixed conditioning reagent formed by mixing a water-soluble polyvalent metal salt with an aqueous solution of an alkali metal silicate, in an amount sufficient to provide from about 0.05 to about 4 pounds of alkali metal silicate per ton of ore, calculated as $SiO_2$ equivalent, and to provide from about 0.02 to about 2 pounds of polyvalent metal salt per ton of ore, and by adding thereto an effective amount of an anionic collector selective to flotation of iron oxide; and subjecting the conditioned pulp to a flotation operation whereby a concentrate containing a major portion of the iron oxide and a tailing relatively rich in silica are produced.

2. A method according to claim 1 wherein said alkali metal silicate is sodium silicate having an $Na_2O$ to $SiO_2$ weight ratio within the range from 1:1 to 1:3.75.

3. A method according to claim 2 wherein said conditioning reagent further includes an inorganic acid in an amount sufficient to provide up to about 2 pounds of the acid per ton of ore;

said polyvalent metal salt contains a cation selected from the group consisting of iron (ferric and ferrous), copper (cupric), aluminum, lead, chromium, manganese, cobalt, nickel, zinc, cadmium, magnesium, calcium, barium and mixtures thereof; and said anionic collector is seleced from the group consisting of saturated and unsaturated fatty acids containing about 8 to about 20 carbon atoms, water-soluble soaps derived from said fatty acids and mixtures thereof.

4. A method according to claim 1 wherein said conditioning reagent further includes an inorganic acid in an amount sufficient to provide up to about 2 pounds of the acid per ton of ore.

5. A method according to claim 1 wherein said polyvalent metal salt contains a cation selected from the group consisting of iron (ferric and ferrous), copper (cupric), aluminum, lead, chromium, manganese, cobalt, nickel, zinc, cadmium, magnesium, calcium, barium and mixtures thereof.

6. A method according to claim 2 wherein said sodium silicate has a $Na_2O$ to $SiO_2$ weight ratio of about 1:3.22 and said polyvalent metal salt is ferric nitrate.

7. A method according to claim 1 wherein said anionic collector is selected from the group consisting of saturated and unsaturated fatty acids containing about 8 to about 20 carbon atoms, water-soluble soaps derived from said fatty acids and mixtures thereof.

8. A method according to claim 1 including the step of adding up to about 0.5 pounds of a frothing agent per ton of ore to the conditioned pulp prior to the flotation opration.

9. A method according to claim 1 including adding a sufficient amount of a water-soluble alkaline inorganic compound, to the pulp prior to the conditioning step to adjust the pH thereof within the range of about 7 to about 11.

10. A method according to claim 1 wherein the pH of the conditioned pulp is within the range of about 6 to about 10 prior to the addition of said collector.

11. A method according to claim 1 wherein the solids content of the pulp is within the range of about 5 to about 30% during said conditioning step.

12. A method according to claim 1 wherein the ore in the pulp is a slimy ore.

* * * * *